US008550217B2

(12) United States Patent
Valjus et al.

(10) Patent No.: US 8,550,217 B2
(45) Date of Patent: Oct. 8, 2013

(54) ELEVATOR

(75) Inventors: Petteri Valjus, Helsinki (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 552 days.

(21) Appl. No.: 12/761,989

(22) Filed: Apr. 16, 2010

(65) Prior Publication Data

US 2010/0219023 A1 Sep. 2, 2010

Related U.S. Application Data

(63) Continuation of application No. PCT/FI2008/000110, filed on Oct. 16, 2008.

(30) Foreign Application Priority Data

Oct. 18, 2007 (FI) ..... 20070782

(51) Int. Cl.
*B66B 5/00* (2006.01)
*B66B 5/04* (2006.01)
*B66B 1/34* (2006.01)

(52) U.S. Cl.
USPC ..... 187/350; 187/373; 187/391

(58) Field of Classification Search
USPC ..... 187/350, 373, 374, 375, 376, 283, 187/291
IPC ..... B66B 5/04, 5/18, 5/22
See application file for complete search history.

(56) References Cited

U.S. PATENT DOCUMENTS

| | | | | |
|---|---|---|---|---|
| 1,873,829 | A * | 8/1932 | Dunlop | 187/376 |
| 2,298,167 | A * | 10/1942 | Rissler | 187/352 |
| 4,083,432 | A * | 4/1978 | Lusti | 187/373 |
| 5,377,788 | A * | 1/1995 | Biewald et al. | 187/374 |
| 5,648,644 | A * | 7/1997 | Nagel | 187/288 |
| 5,869,794 | A * | 2/1999 | Spiess | 187/287 |
| 6,719,101 | B2 * | 4/2004 | Hugel | 187/376 |
| 2004/0178023 | A1 * | 9/2004 | Maury | 187/373 |
| 2006/0180406 | A1 * | 8/2006 | Gremaud et al. | 187/355 |
| 2007/0181378 | A1 * | 8/2007 | Kigawa et al. | 187/376 |
| 2007/0221453 | A1 * | 9/2007 | Windlin et al. | 187/373 |
| 2008/0128217 | A1 * | 6/2008 | Kattainen et al. | 187/247 |

FOREIGN PATENT DOCUMENTS

DE 19616344 A1 11/1997

OTHER PUBLICATIONS

DE19616344 English Translation.*

* cited by examiner

*Primary Examiner* — William E Dondero
*Assistant Examiner* — Minh Truong
(74) *Attorney, Agent, or Firm* — Birch, Stewart, Kolasch & Birch, LLP

(57) ABSTRACT

The invention relates to an elevator provided with a safety gear arrangement, the elevator including at least an elevator car arranged to travel back and forth substantially vertically along guide rails, at least two safety gear mechanisms disposed in conjunction with the elevator car and at least one speed limiter, which includes at least a speed limiter pulley, a diverting pulley and a speed limiter rope fitted as a loop around at least the speed limiter pulley and the diverting pulley, the speed limiter rope being connected at least to a first safety gear mechanism. A second safety gear mechanism has been arranged to be triggered after the triggering of the first safety gear mechanism.

13 Claims, 6 Drawing Sheets

ELEVATOR

Figure 1:
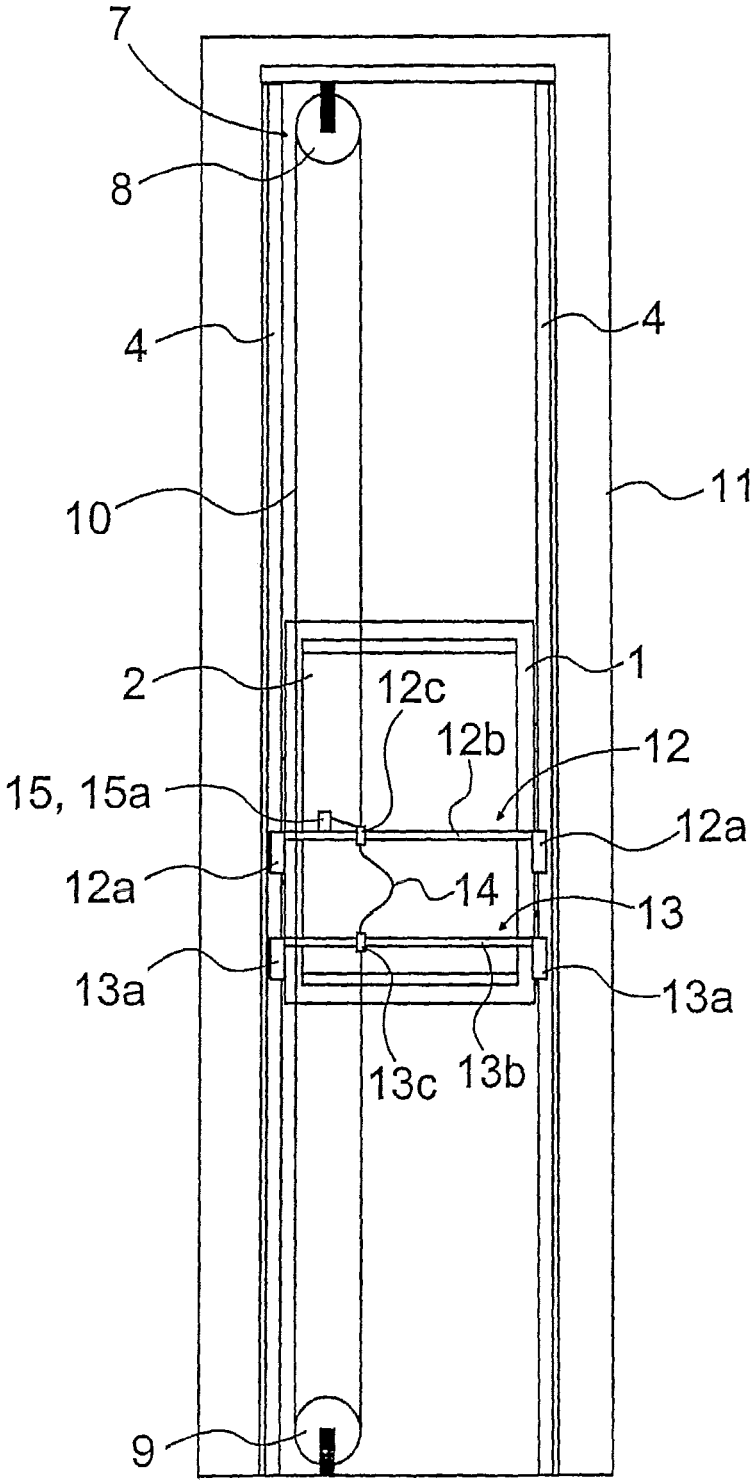

This application is a Continuation of PCT International Application No. PCT/FI2008/000110 filed on Oct. 16, 2008, which designated the United States, and on which priority is claimed under 35 U.S.C. §120. This application also claims priority under 35 U.S.C. §119(a) on Patent Application No. 20070782 filed in Finland on Oct. 18, 2007. The entire contents of each of the above documents is hereby incorporated by reference into the present application.

The present invention relates to an elevator provided with a safety gear arrangement.

According to safety regulations, elevators are required to be provided with equipment for monitoring the speed of the elevator car and for stopping the movement of the elevator car if a predetermined maximum speed is exceeded or the elevator starts moving without being commanded to when standing at a floor. An overspeed situation may arise e.g. if the hoisting ropes of the elevator start slipping due to insufficient friction or if the hoisting ropes break, the control system goes berserk or if the traction sheave shaft breaks and the elevator starts falling freely in the elevator hoistway. The aforesaid equipment monitoring the speed usually comprises at least a speed limiter, which has been arranged to monitor the speed to ensure that the maximum speed will not be exceeded, and a safety gear mechanism forming a pair of safety gears, which is connected to the speed limiter and attached to the elevator car or car frame and which stops the elevator car in the event of overspeed upon being activated by the speed limiter. The safety gear mechanism comprises e.g. two safety gears, a first one of which has been arranged to grip in an overspeed situation a first guide rail guiding the elevator car while a second one has been arranged to grip a second guide rail guiding the elevator car. The safety gear arrangement additionally comprises a synchronizing lever connecting the two safety gears together to form a safety gear pair, ensuring that their gripping actions take place simultaneously.

Elevator speed limiters are generally mechanical pulley and rope systems, comprising a speed limiter pulley mounted e.g. in the upper part of the elevator shaft, a diverting pulley in the lower part of the elevator shaft and a speed limiter rope fitted to run in a substantially tight closed loop around these pulleys. The speed limiter is connected to the synchronizing lever of the safety gear mechanism by this rope, which, when the elevator car is moving, runs around the speed limiter pulley and the diverting pulley. If the elevator car and therefore the speed limiter rope move at an excessive speed, then the rotation of the speed limiter pulley in the upper part of the elevator shaft is stopped by a mechanism activated e.g. by centrifugal force and at the same time the speed limiter rope also stops moving, with the result that the speed limiter rope exerts a pull on the synchronizing lever, causing the wedges of the safety gears to engage the guide rails guiding the elevator car, whereupon the elevator car stops moving.

In some elevators, such as e.g. those made for large hoisting heights, i.e. so-called high-rise or mega-high-rise elevators, for reasons of design dimensioning, two safety gear pairs are often used instead of one. In prior-art solutions using two safety gear pairs, both safety gear pairs are connected to the same speed limiter rope and the safety gear pairs are arranged to grip the guide rails substantially simultaneously. Such a solution involves the problem that a gripping action is always performed by both safety gear pairs, regardless of the gripping force required. However, in certain situations it is not necessary to apply the full gripping force; instead, it would be sufficient for only one of the safety gear pairs to grip. If a first safety gear pair is able to stop the movement of the elevator car with suitable deceleration, then it would be unnecessary for a second safety gear pair to grip at all. Every time when a gripping action is performed, wear of the safety gears and guide rails results, and therefore it would be preferable to keep the other safety gear pair inactive if its gripping action is not necessary.

In the above-described prior-art solution, the gripping action is performed by using both safety gear pairs according to regulations, with full gripping capacity regardless of the situation. Performing the gripping action with both safety gear pairs causes needless problems in a situation where it would not be necessary to use both safety gears e.g. due to a light load in the elevator car. In the case of a non-loaded elevator car, the activation of both safety gear pairs may produce such a high rate of deceleration of the elevator car and its equipment that damage may result. Performing the gripping action with both safety gear pairs may also increase the amount of maintenance work needed after the gripping action as well as the costs as compared to a gripping action performed using only one safety gear pair. A situation where a breakage of the hoisting ropes or traction sheave shaft occurs is very rare. Even in this case it may be sufficient to activate only one safety gear pair if the elevator car has only a small load or if the car is located near the lower end of the hoistway. Thus, in practice a gripping action by both safety gear pairs is very rarely necessary.

Another situation where a gripping action by the second safety gear pair is unnecessary is when the elevator car starts creeping, so to speak, which means that, for example in a loading situation with the elevator car standing at a landing, the car starts moving slowly downwards from the landing if the motor brakes have a reduced holding capacity or if the friction between the elevator hoisting ropes and the rope grooves of the traction sheave is insufficient to hold the elevator car immovable. As is known, excessive downward creeping of the car e.g. during loading can be prevented via the so-called anti-creep function of the speed limiter, which has been arranged to stop the car creeping e.g. by means of a safety gear. In such a situation, too, a gripping action by only one safety gear pair would thus be sufficient.

Elevator regulations stipulate that the deceleration of the elevator car during gripping action should remain within a certain prescribed range. This requirement may be difficult to meet, because in the above-described solutions the gripping force is always substantially the same, whereas the load present in the elevator car may vary quite widely in different situations. Previously known expedients aiming at solving this problem include means provided in conjunction with the safety gear mechanism to regulate the gripping force and keep the deceleration within the range stipulated by elevator regulations. A solution of this type is disclosed in U.S. Pat. No. 6,719,101. However, this solution involves the problem that, even if it does keep the deceleration within a prescribed range, the solution is complex and expensive to implement due to a short feedback reaction time, large forces and sensor techniques. Moreover, the complexity entails a risk of reliability problems arising in operation, and if these problems materialize, they may jeopardize passenger safety.

The object of the present invention is to overcome the above-mentioned drawbacks and to achieve a simple, economical and reliable elevator provided with a safety gear arrangement, wherein the safety gear gripping action is not always effected with full force but in a staggered manner with a suitable force according to the situation. A further object of the invention is to enable, by applying the said arrangement, the deceleration of the elevator car during gripping action to be kept within the range defined by elevator regulations without complex and expensive control equipment.

Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Likewise, different details described in connection with each embodiment example of the invention can be applied in conjunction with other embodiment examples as well. It may be further stated that at least some of the sub-claims can at least in appropriate situations be considered as being inventive in themselves.

The elevator provided with a safety gear arrangement according to the invention comprises at least an elevator car arranged to move back and forth along guide rails mounted in a substantially vertical orientation, at least two safety gear mechanisms disposed in conjunction with the elevator car and at least one speed limiter, which comprises at least a speed limiter pulley, a diverting pulley and a speed limiter rope fitted as a loop around at least the speed limiter pulley and the diverting pulley, said speed limiter rope being connected at least to a first safety gear mechanism. According to the invention, a second safety gear mechanism has been arranged to be triggered after the triggering of the first safety gear mechanism.

In an embodiment of the invention, the elevator comprises at least actuating means for triggering the second safety gear mechanism after the triggering of the first safety gear mechanism.

In an embodiment of the invention, the elevator has, as an actuating means for triggering the second safety gear mechanism, a timer, by means of which the second safety gear mechanism has been arranged to be triggered upon the lapse of a predetermined time delay after the triggering of the first safety gear mechanism.

An elevator according to an embodiment of the invention has, as an actuating means for triggering the second safety gear mechanism, an acceleration sensor adapted to monitor the deceleration of the elevator car, the second safety gear mechanism being arranged to be triggered by the said acceleration sensor if the deceleration of the elevator car effected by the first safety gear mechanism does not exceed a predetermined limit value.

An elevator according to an embodiment of the invention has, as an actuating means for triggering the second safety gear mechanism, a pulse transducer adapted to monitor the deceleration of the elevator car, the second safety gear mechanism being arranged to be triggered by the said pulse transducer if the deceleration of the elevator car effected by the first safety gear mechanism does not exceed a predetermined limit value.

In an elevator according to an embodiment of the invention, the speed limiter rope is releasably connected to the first safety gear mechanism by means of a clamping element, and fixedly connected to the second safety gear mechanism by means of a clamping element.

An elevator according to an embodiment of the invention has a timer connected to the clamping element of the first safety gear mechanism, the said timer being arranged to be activated when the first safety gear mechanism is triggered and to release the holding grip of the first clamping element on the speed limiter rope upon the lapse of a period of time set on the timer.

An elevator according to an embodiment of the invention has an acceleration sensor or a pulse transducer connected to the clamping element of the first safety gear mechanism, the said acceleration sensor or pulse transducer being arranged to monitor the deceleration of the elevator car at least after the first safety gear mechanism has been triggered and to release the holding grip of the first clamping element on the speed limiter rope if the deceleration of the elevator car is below a pre-set limit value.

In an elevator according to an embodiment of the invention, that portion of the speed limiter rope which extends between the clamping element of the first safety gear mechanism and the clamping element of the second safety gear mechanism has been arranged to form a substantially slack link, the length of this link being substantially greater than the distance between the clamping elements when a gripping action has been performed by the first safety gear mechanism.

An elevator according to an embodiment of the invention comprises at least one second speed limiter, which comprises at least a speed limiter pulley, a diverting pulley and a speed limiter rope fitted as a loop around at least the speed limiter pulley and the diverting pulley, the rope of the first speed limiter being connected by means of a clamping element to a synchronizing element of the first safety gear mechanism while the rope of the second speed limiter is connected by means of a clamping element to a synchronizing element of the second safety gear mechanism.

In an elevator according to an embodiment of the invention, the triggering speed of the second speed limiter is faster than the triggering speed of the first speed limiter.

In an elevator according to an embodiment of the invention, the speed limiters are connected to a timer which has been arranged to be started when the first speed limiter is triggered and to activate, after a length of time set on the timer has elapsed, a remote triggering function for triggering the second speed limiter.

In an elevator according to an embodiment of the invention, the actuating means triggering the second safety gear mechanism is an acceleration sensor for measuring deceleration of the elevator car, said acceleration sensor being arranged to measure the elevator car deceleration after the gripping action of the first safety gear mechanism and to activate the remote triggering function for triggering the second speed limiter if the deceleration of the elevator car is below a preset limit value.

In an elevator according to an embodiment of the invention, the actuating means triggering the second safety gear mechanism is a pulse transducer for measuring the deceleration of the elevator car, said pulse transducer being arranged to measure the elevator car deceleration after the gripping action of the first safety gear mechanism and to activate the remote triggering function for triggering the second speed limiter if the deceleration of the elevator car is below a preset limit value.

In an elevator according to an embodiment of the invention, the second safety gear mechanism has been arranged to be triggered after the elevator car speed has begun to slow down.

In an elevator according to an embodiment of the invention, the second safety gear mechanism has been arranged to be triggered at a speed that is equal to or lower than the speed at which the first safety gear mechanism has been arranged to be triggered.

In an elevator according to an embodiment of the invention, the pulling effect of the speed limiter rope has been arranged to be transmitted to the second safety gear mechanism only after the first safety gear mechanism has been triggered.

One of the advantages of the elevator of the invention is the fact that the gripping action is not performed with the total gripping force of all the safety gear units, i.e. with full gripping capacity, if this is not necessary, which reduces wear of the safety gears and guide rails as well as maintenance work and costs. A further advantage of the invention is that the invention solves the requirement of keeping the deceleration during safety gear action, via a stopping distance corresponding to the velocity value, within the range of 0.2*g . . . 1*g prescribed by the Norms EN81-1 and A17.1, where g=earth's gravitational acceleration, this requirement being problematic for so-called mega-high-rise elevators. The solution is implemented using two safety gear pairs, of which a first safety gear pair is arranged to function in "ropes intact" situations with all loads and elevator car positions while correspondingly a second safety gear pair has been adapted to function in such a way that the additional gripping force required in a "ropes broken" situation will be provided. The additional gripping force has been calculated for a situation where the hoisting ropes break when the elevator car is located at the upper end of the shaft with full load. In this case, a decelerating capacity of at least 0.2*g is required.

A further advantage is that in practice only one of the safety gear pairs undergoes wear. An additional advantage is that the second safety gear pair only performs a gripping action in really rare emergency situations, i.e. practically only when the elevator hoisting ropes break. This feature reduces the maintenance work and costs after the gripping action, because the second safety gear practically does not need any maintenance or adjustment at all and the elevator adjustments are not disturbed by an unnecessarily high deceleration rate. In very tall buildings, so-called mega-high-rise elevators are in any case already provided with two safety gear pairs (so-called duplex system), so in these systems the solution of the invention will not involve any substantial cost increase. Yet another advantage is that the safety gear arrangement of the invention is reliable in operation, simple and economical to implement.

The invention further provides the advantage that it allows the elevator car deceleration to be increased even in situations where the first safety gear mechanism has been triggered and is already decelerating the travel of the elevator car but the deceleration is not sufficient, i.e. deceleration does not exceed a predetermined limit value. In an elevator according to the invention, the second safety gear mechanism can be triggered at a speed that is equal to or lower than the speed at which the first safety gear mechanism was triggered.

Figure 2:
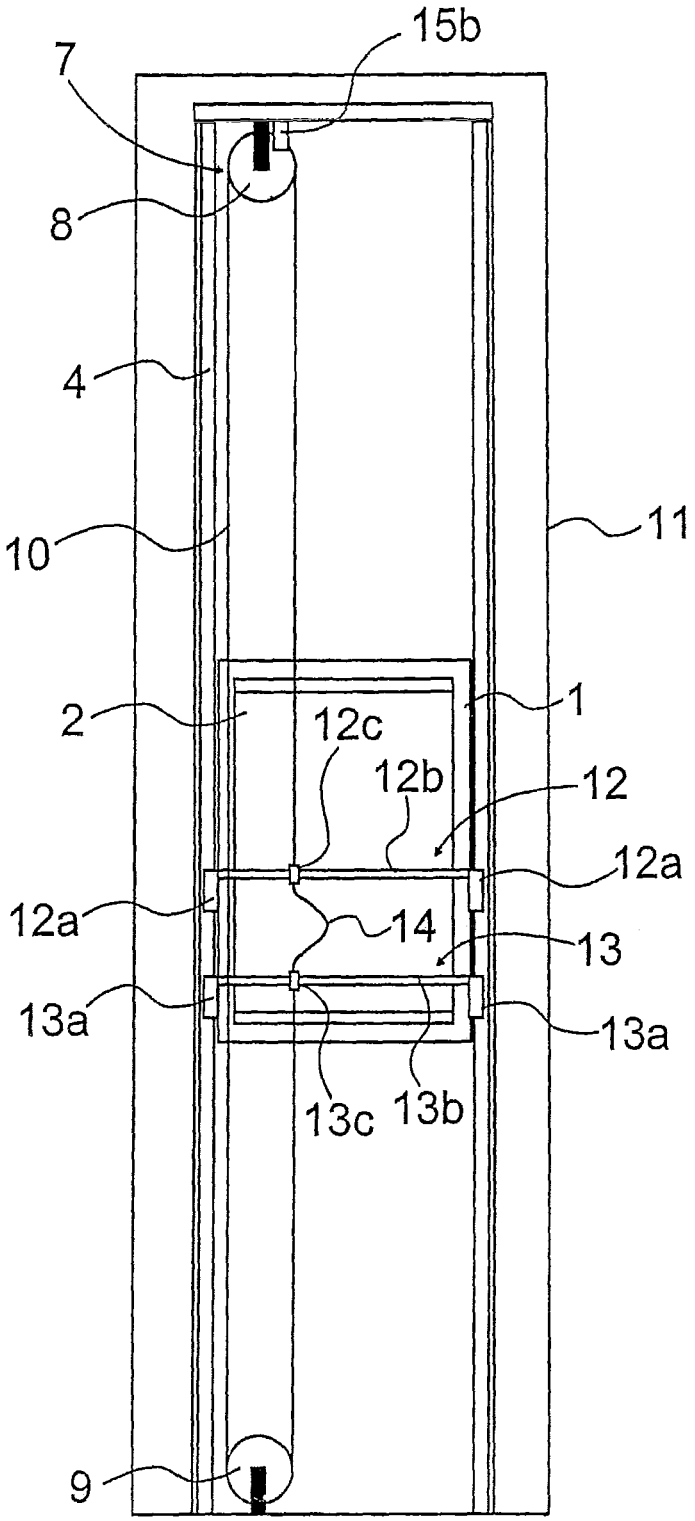
Figure 3:
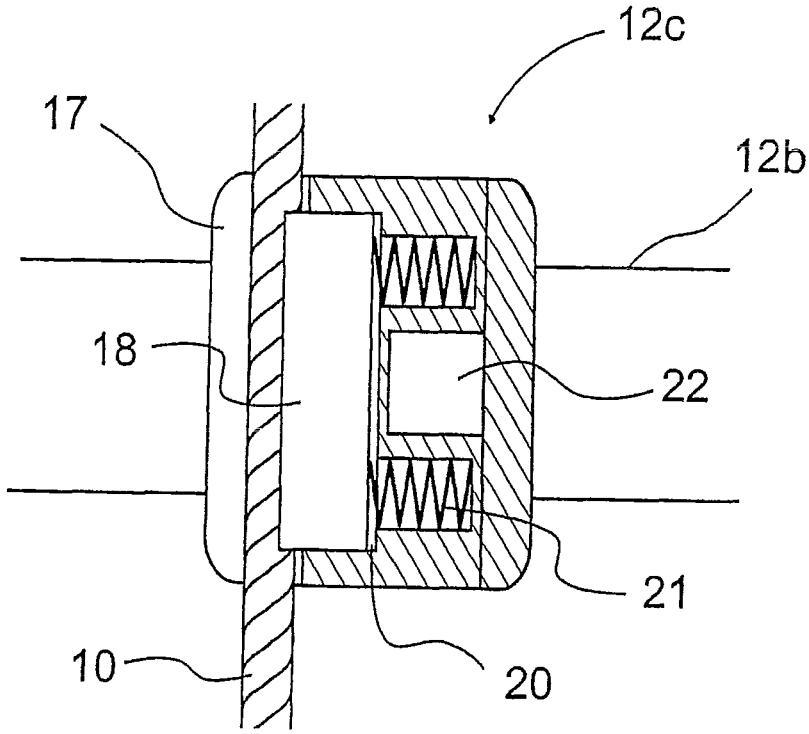
Figure 4:
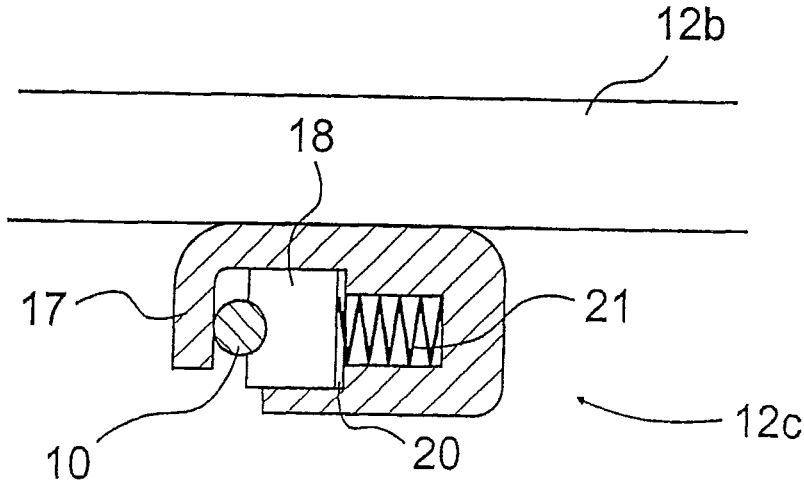
Figure 5:
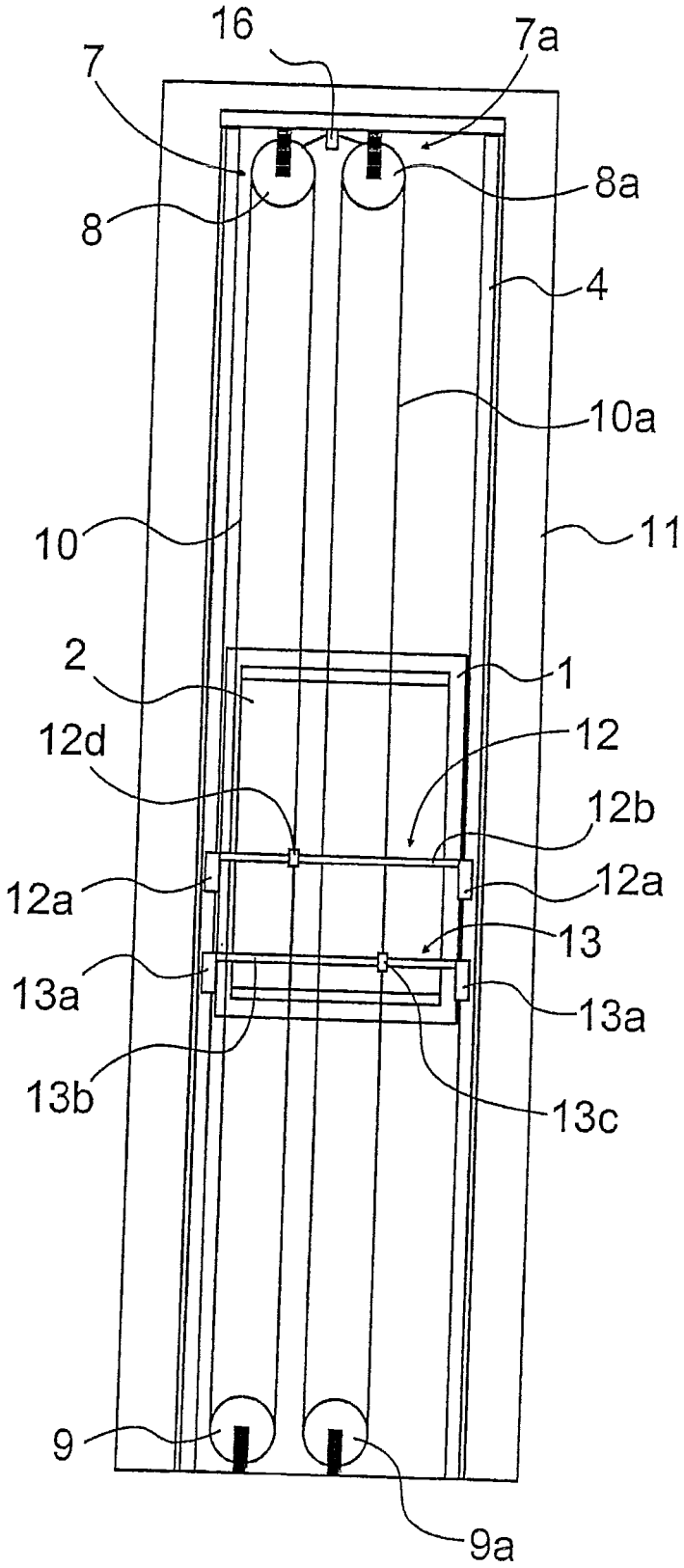
Figure 6:
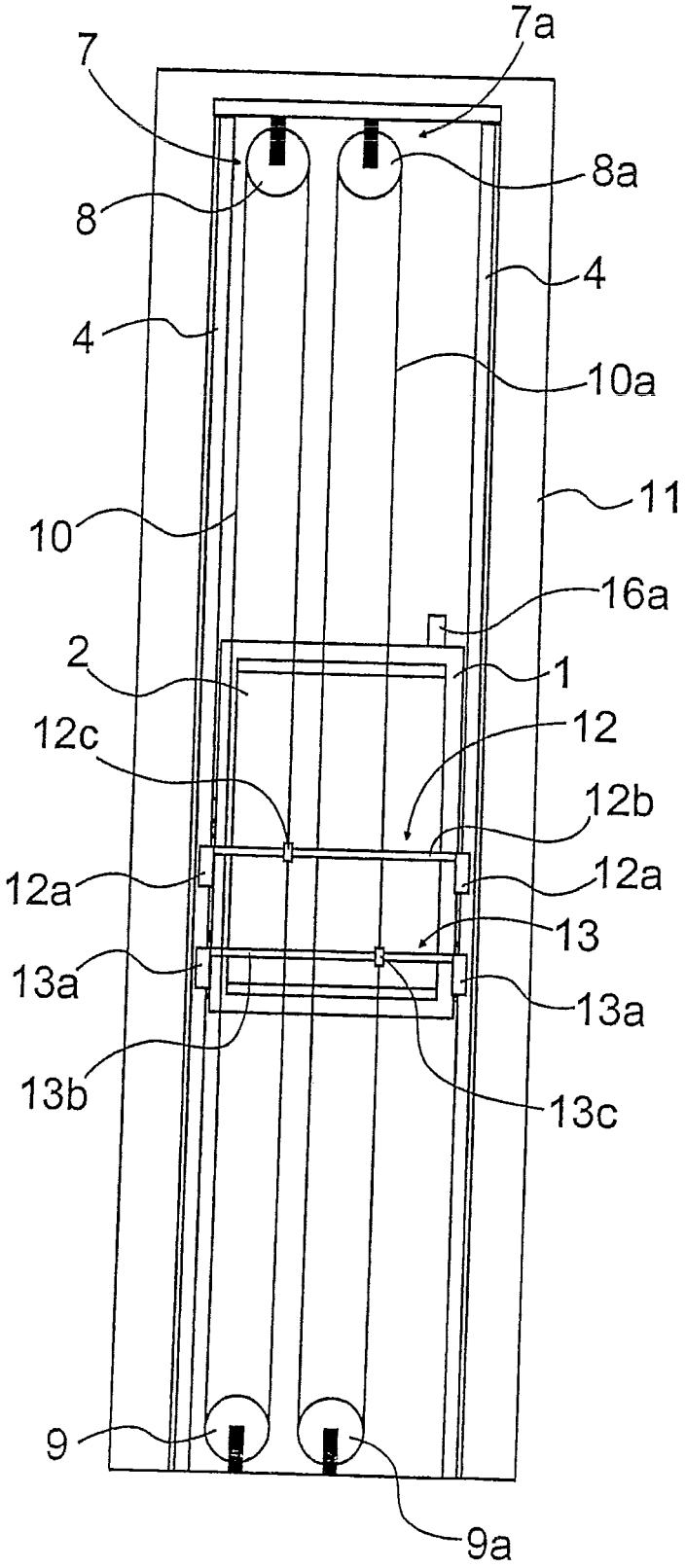
Figure 7:
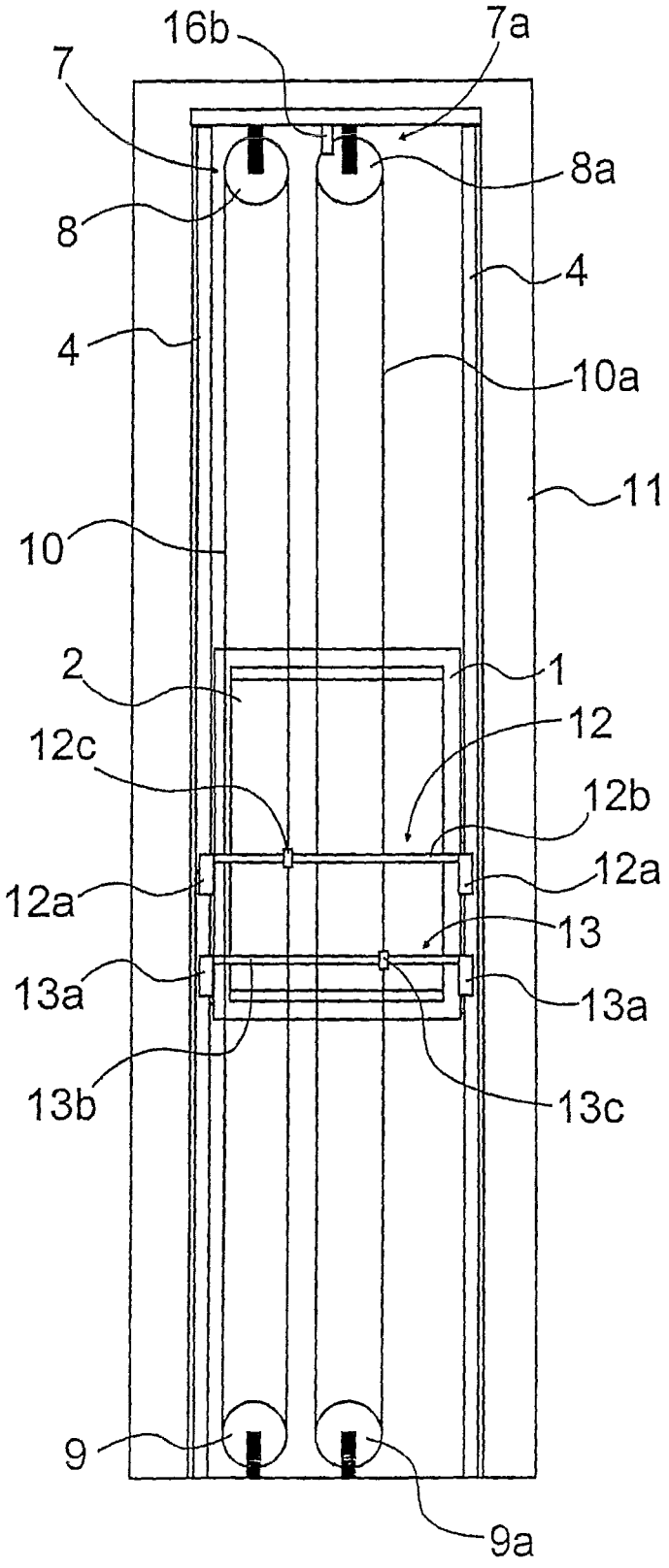

In the following, the invention will be described in greater detail by referring to three embodiment examples and the attached drawings, wherein FIG. 1 presents a simplified and diagrammatic rear view of an elevator in which an embodiment of the safety gear arrangement of the invention is used, FIG. 2 presents a simplified and diagrammatic rear view of an elevator in which a second embodiment of the safety gear arrangement of the invention is used, FIG. 3 presents a simplified, diagrammatic and partially sectioned rear view of a clamping element for the speed limiter rope of the first safety gear in a solution as illustrated in FIGS. 1 and 2, FIG. 4 presents a simplified, diagrammatic and partially sectioned top view of a clamping element for the speed limiter rope of the first safety gear in a solution as illustrated in FIGS. 1 and 2, FIG. 5 presents a simplified and diagrammatic rear view of an elevator in which an embodiment of the safety gear arrangement of the invention based on two speed limiters is used, FIG. 6 presents a simplified and diagrammatic rear view of an elevator in which a second embodiment of the safety gear arrangement of the invention based on two speed limiters is used, and FIG. 7 presents a simplified and diagrammatic rear view of an elevator in which a third embodiment of the safety gear arrangement of the invention based on two speed limiters is used.

FIG. 1 presents a simplified and diagrammatic rear view of an elevator in which an embodiment of the safety gear arrangement of the invention is used. For the sake of clarity, some parts of the elevator, including the hoisting machine and ropes and associated components as well as the guide rollers and/or sliding guides on the guide rails, have been omitted from the figure. An elevator car 2 fitted in a car frame 1 and driven by a separate hoisting machine, which is not shown in the figure, has been arranged to move in an elevator shaft 11 along guide rails 4 in a substantially vertical direction. Mounted in the upper part of the elevator shaft 11 is a speed limiter pulley 8 comprised in the speed limiter 7 and in the lower part a diverting pulley 9 comprised in the speed limiter 7. Fitted as a loop around these pulleys is a speed limiter rope 10 under a suitable tension.

The car frame 1 is provided with two safety gear mechanisms 12 and 13, each comprising two safety gears, which are secured to the outer edges of the car frame 1 and placed around the elevator guide rails 4 to move along them. In addition, each safety gear mechanism 12, 13 comprises at least a synchronizing element connecting the two safety gears. The safety gears of the first safety gear mechanism 12 are indicated in the figure by reference number 12*a* while the safety gears of the second safety gear mechanism 13 are indicated by reference number 13*a*. In the same way, the synchronizing element of the first safety gear mechanism 12 is denoted in the figure by reference number 12*b* while the synchronizing element of the second safety gear mechanism 13 is denoted by reference number 13*b*. The synchronizing elements 12*b* and 13*b* are e.g. lever mechanisms or torsion bars attached to the safety gears of the safety gear mechanisms. The first safety gear mechanism 12 is placed at a suitable distance above the second safety gear mechanism 13.

The speed limiter rope 10 is connected to the two safety gear mechanisms 12 and 13 in such manner that the rope 10 is secured to the first synchronizing element 12*b* by means of a first clamping element 12*c* and to the second synchronizing element 13*b* by means of a second clamping element 13*c*. That portion of the speed limiter rope which remains between the first and the second safety gear mechanisms is not straight, but in its normal operating position it has been left to form a loose link 14, which is essential to this embodiment of the invention.

The speed limiter 7 has been arranged to function in such manner that, when the elevator car 2 is moving downwards at an excessive speed, the speed limiter pulley 8, being rotated by the motion of the elevator car 2, is stopped e.g. by the action of centrifugal force, thereby arresting the motion of the speed limiter rope 10. Now, as the elevator car 2 is still moving downwards, the arrested rope 10 pulls via synchronizing element 12*b* the wedges comprised in the safety gears 12*a* of the first safety gear mechanism 12 into contact with the guide rails 4, whereupon the motion of the elevator car 2 begins to slow down. Thus, when the speed limiter 7 is triggered, the rope 10 pulls the first synchronizing element 12*b* upwards relative to the elevator car 2, thereby causing the loose link 14 in the speed limiter rope 10 between the safety gear mechanisms 12 and 13 to be tightened by an amount corresponding to the distance of movement of the first synchronizing element 12*b*. However, the link 14 has been designed to have a sufficient length such that it will not be tightened completely when a gripping action of the first safety gear mechanism 12 occurs, and therefore it will not yet trigger the second safety gear mechanism 13. Thus, the tightenable loose length of the link 14 is substantially greater than the distance of movement of the first synchronizing element 12*b* of the first safety gear 12 during the gripping action, in other words, the link 14 has a length substantially greater than the mutual distance between the clamping elements 12*c* and 13*c* in a situation where a gripping action has been performed by the first safety gear mechanism 12.

Fitted in conjunction with the first safety gear mechanism 12 are additionally actuating means for triggering the second safety gear mechanism 13, said actuating means being connected to the first clamping element 12*c*. The actuating means may be e.g. a mechanical or electrical timer 15 arranged to be activated by an appropriate switch connected to the timer 15 when the first safety gear mechanism 12 is triggered. The switch may be placed on the speed limiter 7 or e.g. in conjunction with the first safety gear mechanism 12. The first clamping element 12*c* has been arranged to release its grip on the speed limiter rope 10 when a time preset on the timer 15 has elapsed. If the elevator car 2 has not stopped by this time as a result of the braking force applied by the first safety gear mechanism 12 but still continues moving downwards, then the link 14 between the synchronizing elements 12*b* and 13*b* is tightened further and straightened out, whereupon the speed limiter rope 10 pulls by means of synchronizing element 13*b* the wedges of the safety gears 13*a* of the second safety gear mechanism 13 as well into contact with the guide rails 4. In this way, the pulling effect (force) of the speed limiter rope 10 which results from the speed limiter pulley stop-ping/slowing down and which has been designed to pull the safety gears of the safety gear mechanisms on the moving elevator car towards the braking position has been arranged to be only transmitted to the second safety gear mechanism 13 after the first safety gear mechanism 12 has been triggered, preferably so that after the triggering of safety gear mechanism 12 at least a small time delay (preferably e.g. 0.5-2 s, most preferably 2 s) elapses before the aforesaid pulling effect is transmitted to safety gear mechanism 13. The gripping forces of the safety gear mechanisms 12 and 13 are most preferably so designed that, when both safety gear mechanisms perform a gripping action, the motion of the elevator car 2 will be reliably stopped. It may also happen that, even if the motion of the elevator car 2 has not stopped completely within the time preset on the timer 15 and the link 14 begins to be straightened out as the first clamping element 12*c* releases its grip on the speed limiter rope 10, the elevator car 2 has been decelerated enough by the first safety gear mechanism 12 to stop moving before the link 14 is completely straightened out. In this case, the rope 10 will not trigger the second safety gear mechanism 13.

Instead of a timer 15, the actuating means may as well be an acceleration sensor 15*a* arranged to be movable along with the elevator car 2 and fitted to measure the deceleration of the elevator car 2 after the triggering of the first safety gear mechanism 12 and to trigger the second safety gear mechanism 13 by releasing the hold of the clamping element 12*c* on the rope 10 of the speed limiter 7 if the deceleration of the elevator car 2 effected by the first safety gear mechanism 12 does not exceed a predetermined limit value.

As shown in FIG. 2, the actuating means triggering the second safety gear mechanism 13 may also be a pulse transducer 15*b*, which is connected to the speed limiter 7 to monitor the velocity of the elevator car 2 and thereby to mathematically measure and calculate the deceleration of the car after the first safety gear mechanism 12 has been triggered and to trigger the second safety gear mechanism 13 by releasing the hold of the clamping element 12*c* on the rope 10 of the speed limiter 7 if the deceleration of the elevator car 2 effected by the first safety gear mechanism 12 does not exceed a predetermined limit value.

FIGS. 3 and 4 present a first clamping element 12*c* for the speed limiter rope 10, which element is applicable in the solution of the invention to fasten the speed limiter rope 10 to the synchronizing element 12*b* of the upper or first safety gear mechanism 12. The first clamping element 12*c* is secured to the synchronizing element 12*b* of the first safety gear mechanism 12 e.g. by means of screws or other suitable fastening devices, which are not shown in the figures. The first clamping element 12*c* comprises at least a frame with a vertical space inside it, where the speed limiter rope 10 is placed so that it runs through the clamping element 12*c* substantially vertically. The frame comprises a stopper portion 17, against which the speed limiter rope 10 has been fitted to be pressed. In addition, the frame of the clamping element 12*c* has inside it a hollow space 20, where a compression piece 18 has been fitted to move substantially horizontally towards and away from the speed limiter rope 10. In its normal position, the compression piece 18 has been arranged to press the speed limiter rope 10 against the stopper portion 17 by means of springs 21 provided in the frame. The spring force of the springs 21 has been so chosen that the compression force will be sufficient to trigger the safety gear and to keep the rope 10 immovable relative to the clamping element 12*c* even after a gripping action has taken place. Moreover, the frame of the clamping element 12*c* is provided with an electromagnet 22, which is connected to the timer 15. The timer 15 is activated during safety gear action e.g. by means of a limit switch or equivalent, and it has been adapted to connect electric power to the electromagnet 22 in the clamping element 12*c* upon the lapse of a predetermined length of time, whereupon the electromagnet 22 exerts on the compression piece 18 a pull against the spring force of the springs 21, causing the piece to move clear of the speed limiter rope 10. Now, if the elevator car is still moving, the link 14 between the synchronizing elements 12*b* and 13*b* is straightened out, whereupon the speed limiter rope 10 activates the second safety gear mechanism 13 as well and stops the movement of the elevator car.

FIG. 5 presents a simplified and diagrammatic rear view of an elevator in which an embodiment of the safety gear arrangement of the invention based on two speed limiters is used. In this solution, both speed limiters 7 and 7*a* are in operating principle and construction identical with the speed limiters in the embodiments presented in FIGS. 1 and 2. In addition, the car frame 1 is provided with two substantially identical safety gear mechanisms 12 and 13, as in the above-described embodiments, too. The rope 10 of the first speed limiter 7 is secured by means of clamping element 12*d* to the synchronizing element 12*b* of the first or upper safety gear mechanism 12, and the rope 10*a* of the second speed limiter 7*a* is secured by means of clamping element 13*c* to the synchronizing element 13*b* of the second or lower safety gear mechanism 13.

In an overspeed situation, the first speed limiter 7 has been arranged to stop the motion of the respective rope 10, causing the safety gears 12*a* of the first safety gear mechanism 12 to grip the guide rails 4. Connected to the first speed limiter 7 is a timer 16 serving as an actuating means and arranged to be activated e.g. by a suitable switch when the first speed limiter 7 is triggered. The switch is most appropriately disposed in conjunction with the first speed limiter 7, but it may also be placed elsewhere. The timer 16 is additionally connected to a remote triggering system for triggering the second speed limiter 7*a*, and when the time preset on the timer 16 has elapsed, the timer 16 has been arranged to activate a remote triggering function for triggering the second speed limiter 7*a*, which triggers the second speed limiter 7*a* e.g. by means of a solenoid or a corresponding actuating element fitted in conjunction with the second speed limiter pulley 8*a*. In so-called normal situations of safety gear action, the elevator car 2 has already stopped by this time, so the rope 10*a* of the second speed limiter will not trigger the second safety gear mechanism 13. The second safety gear mechanism 13 has been adapted to be only triggered in situations where the first safety gear mechanism 12 is insufficient to stop the elevator car 2 quickly enough. The second speed limiter 7*a* may also be triggered independently e.g. due to centrifugal force if the speed of the elevator car 2 for some reason still continues accelerating even after the gripping function of the first safety gear mechanism 12 has been activated. The speed which triggers the second speed limiter 7*a* independently has been adjusted to a higher value than the corresponding speed set for the first speed limiter 7, and consequently the first speed limiter 7 is in any case always triggered first whereas the second speed limiter 7*a* is not triggered until the timer 16 triggers it or if the speed of the elevator car 2 increases beyond the limit preset for the second speed limiter 7*a*.

FIG. 6 presents a simplified and diagrammatic rear view of an elevator in which another embodiment of the safety gear arrangement of the invention based on two speed limiters is used. As in the above-described embodiment, this embodiment also has two speed limiters 7 and 7*a*, the ropes 10 and 10*a* of which are attached to the synchronizing elements 12*b* and 13*b* of two separate safety gear mechanisms 12 and 13 by means of clamping elements 12*d* and 13*c*. The first speed limiter 7 has been arranged to trigger the first safety gear mechanism 12 in overspeed situations in the normal manner. Mounted on the car frame 1 or on the elevator car 2 is an accelerometer 16*a*, which moves along with the movement of the elevator car and is connected to the remote triggering system of the second speed limiter 7*a*, and which serves as an actuating means and is arranged to measure the deceleration of the elevator car 2 after a gripping action has been performed by the first safety gear mechanism 12. The same accelerometer can be used during normal operation to measure acceleration and deceleration of the elevator car. In a situation of safety gear action, the deceleration data is utilized for remote triggering of the second speed limiter 7*a*.

If the deceleration of the elevator car 2 after the gripping action of the first safety gear mechanism 12 is not sufficient, i.e. deceleration does not exceed the preset value, the accelerometer 16*a* has been arranged to activate the remote triggering function of the second speed limiter 7*a*, causing the second speed limiter 7*a* to trigger the second safety gear mechanism 13 by means of a solenoid or a corresponding actuating element of remote triggering system fitted e.g. in conjunction with the second speed limiter pulley 8*a*. This solution provides the advantage of fast reaction.

FIG. 7 presents a simplified and diagrammatic rear view of an elevator in which a third embodiment of the safety gear arrangement of the invention, likewise based on two speed limiters, is used. The solution represented by FIG. 7 is largely similar to the solution illustrated in FIG. 6, but in this solution the accelerometer proposed in FIG. 6 has been replaced with a pulse transducer 16*b* disposed in conjunction with the second speed limiter 7*a* and serving as an actuating means, which is connected to the remote triggering system of the second speed limiter 7*a* and arranged to measure the velocity of the elevator car 2 and thus to measure its deceleration after the gripping action of the first safety gear mechanism 12. In the embodiments represented by FIGS. 6 and 7, too, the second speed limiter 7*a* may additionally be triggered independently in a manner corresponding to that described above in connection with FIG. 5, e.g. by the action of centrifugal force, if the velocity of the elevator car 2 for some reason still continues accelerating after the gripping action of the first safety gear mechanism 12.

If after the gripping action of the first safety gear mechanism 12 the deceleration of the elevator car 2 does not exceed the preset value, the pulse transducer 16*b* has been arranged to activate the remote triggering function of the second speed limiter 7*a*, causing the second speed limiter 7*a* to trigger the second safety gear mechanism 13 by means of a solenoid or a corresponding actuating element of a remote triggering system fitted e.g. in conjunction with the second speed limiter pulley 8*a*.

The essential point of the invention is that the safety gear mechanisms 12 and 13 are not triggered simultaneously, but the second safety gear mechanism 13 has been arranged to grip the guide rails 4 only after the gripping action of the first safety gear mechanism 12, if it is at all necessary to activate the second safety gear mechanism 13, too. A need for maximal gripping capacity arises really rarely, and therefore in so-called normal situations requiring safety gear action it is sufficient to use only the first safety gear mechanism 12, which has been designed to function in so-called "ropes intact" situations with any loads and positions of the elevator car and to be triggered e.g. when a control system disturbance results in overspeed of the elevator car. However, if for some reason the gripping force of the first safety gear mechanism 12 is insufficient to stop the elevator car 2 quickly enough, then the second safety gear mechanism 13 is also activated to grip the guide rails 4, the second system being correspondingly designed to produce the additional gripping force required in a so-called "ropes broken" situation. These above-mentioned basic characteristics are common to all the embodiments of the invention described above, although they are implemented in a different manner in each embodiment.

In the event that, after the first safety gear mechanism 12 has been triggered, the speed of the elevator car begins to slow down but is not decelerated sufficiently, the situation is such that the second safety gear mechanism 13 has to be triggered at an elevator car speed that is lower than the speed at which the first safety gear mechanism 12 was triggered. For this reason, in an embodiment of the invention, the second safety gear mechanism 13 has been arranged to be triggered after the elevator car speed has begun to slow down if the deceleration does not exceed a certain preset limit value. Deceleration can be detected e.g. by means of an acceleration sensor or by some other method described earlier in the present application, such as by using a pulse transducer. If necessary, the speed can also be calculated or measured by a prior-art method. All the above-described embodiments can also be adapted to function in this manner if desirable.

It is obvious to the a person skilled in the art that the invention is not exclusively limited to the embodiments example described above, in which the invention has been described by way of example, but that it may many variations and different embodiments of the invention are possible be varied within the scope of the inventive concept defined in the claims presented below. Thus, for example, instead of an electromechanical solution, the first clamping element gripping the speed limiter rope may also be a completely mechanical element. In this case, the rope is held locked to the first clamping element e.g. by a form-locking arrangement and the rope is released upon the lapse of a period of time determined by a timer, by releasing the form-locking connection e.g. by pulling a locking bolt or equivalent away from a locking counterpiece.

It is further obvious to the person skilled in the art that e.g. the construction of the safety gear mechanism may be different from that described above. For example, instead of having two safety gears, a safety gear mechanism may comprise one or more safety gears.

The invention claimed is:

1. An elevator provided with a safety gear arrangement, the elevator comprising:

at least an elevator car arranged to travel back and forth substantially vertically along guide rails;

at least two safety gear mechanisms disposed in conjunction with the elevator car; and at least one speed limiter, which includes:

at least a speed limiter pulley;

a diverting pulley; and a continuous single speed limiter rope fitted as a loop around at least the speed limiter pulley and the diverting pulley, said speed limiter rope being connected at least to a first safety gear mechanism and a second safety gear mechanism, the second gear mechanism being arranged to be triggered after a triggering of the first safety gear mechanism, wherein the speed limiter rope is releasably connected to the first safety gear mechanism by means of a first clamping element, and fixedly connected to the second safety gear mechanism by means of a second clamping element, and wherein a portion of the speed limiter rope which is between the first clamping element of the first safety gear mechanism and the second clamping element of the second safety gear mechanism has been arranged to form a substantially slack link, the length of this slack link being substantially greater than the distance between the first and second clamping elements when a gripping action has been performed by the first safety gear mechanism.

2. The elevator according to claim 1, further comprising at least actuating means for triggering the second safety gear mechanism after the triggering of the first safety gear mechanism.

3. The elevator according to claim 2, further comprising a timer for triggering the second safety gear mechanism, by means of which timer the second safety gear mechanism has been arranged to be triggered upon the lapse of a predetermined time delay after the triggering of the first safety gear mechanism.

4. The elevator according to claim 2, further comprising an actuating means for triggering the second safety gear mechanism, the actuating means including a pulse transducer adapted to monitor the deceleration of the elevator car, the second safety gear mechanism being arranged to be triggered by the actuating means if the deceleration of the elevator car effected by the first safety gear mechanism does not exceed a predetermined limit value.

5. The elevator according to claim 2, wherein the speed limiter rope is releasably connected to the first safety gear mechanism by means of a clamping element, and fixedly connected to the second safety gear mechanism by means of a clamping element.

6. The elevator according to claim 1, further comprising a timer for triggering the second safety gear mechanism, by means of which timer the second safety gear mechanism has been arranged to be triggered upon the lapse of a predetermined time delay after the triggering of the first safety gear mechanism.

7. The elevator according to claim 1, further comprising an actuating means for triggering the second safety gear mechanism, the actuating mean including an acceleration sensor adapted to monitor the deceleration of the elevator car, the second safety gear mechanism being arranged to be triggered by the actuating means if the deceleration of the elevator car effected by the first safety gear mechanism does not exceed a predetermined limit value.

8. The elevator according to claim 1, further comprising an actuating means for triggering the second safety gear mechanism, the actuating means including a pulse transducer adapted to monitor the deceleration of the elevator car, the second safety gear mechanism being arranged to be triggered by the actuating means if the deceleration of the elevator car effected by the first safety gear mechanism does not exceed a predetermined limit value.

9. The elevator according to claim 1, further comprising a timer connected to the first clamping element of the first safety gear mechanism, the said timer being arranged to be activated when the first safety gear mechanism is triggered and to release the holding grip of the first clamping element on the speed limiter rope upon the lapse of a period of time set on the timer.

10. The elevator according to claim 1, further comprising an actuating means for releasing the holding grip of the first clamping element on the speed limiter rope if the deceleration of the elevator car is below a pre-set limit value, the actuating means including an acceleration sensor or a pulse transducer connected to the first clamping element of the first safety gear mechanism, the said acceleration sensor or pulse transducer being arranged to monitor the deceleration of the elevator car at least after the first safety gear mechanism has been triggered.

11. The elevator according to claim 1, wherein the second safety gear mechanism has been arranged to be triggered after the speed of the elevator car has begun to slow down.

12. The elevator according to claim 1, wherein the second safety gear mechanism has been arranged to be triggered at a speed that is equal to or lower than the speed at which the first safety gear mechanism has been arranged to be triggered.

13. The elevator according to claim 1, wherein the pulling effect of the speed limiter rope has been arranged to be transmitted to the second safety gear mechanism only after the first safety gear mechanism has been triggered.

* * * * *